US012180671B2

(12) United States Patent
Tan et al.

(10) Patent No.: US 12,180,671 B2
(45) Date of Patent: Dec. 31, 2024

(54) SKID STEER LOADER

(71) Applicant: SUNWARD INTELLIGENT EQUIPMENT CO., LTD., Changsha (CN)

(72) Inventors: Zeping Tan, Changsha (CN); Zhen Liu, Changsha (CN); Junyi Liu, Changsha (CN); Huiwen Hu, Changsha (CN); Xianghua Xie, Changsha (CN); Zhengyu Gan, Changsha (CN)

(73) Assignee: SUNWARD INTELLIGENT EQUIPMENT CO., LTD., Changsha (CN)

( * ) Notice: Subject to any disclaimer, the term of this patent is extended or adjusted under 35 U.S.C. 154(b) by 225 days.

(21) Appl. No.: 17/782,639

(22) PCT Filed: Dec. 19, 2019

(86) PCT No.: PCT/CN2019/126626
§ 371 (c)(1),
(2) Date: Jun. 3, 2022

(87) PCT Pub. No.: WO2021/109262
PCT Pub. Date: Jun. 10, 2021

(65) Prior Publication Data

US 2023/0018044 A1 Jan. 19, 2023

(30) Foreign Application Priority Data

Dec. 6, 2019 (CN) ..... 201911241020.7

(51) Int. Cl.
*E02F 3/34* (2006.01)
*E02F 3/38* (2006.01)
(Continued)

(52) U.S. Cl.
CPC ..... *E02F 3/3405* (2013.01); *E02F 3/3402* (2013.01); *E02F 3/38* (2013.01);
(Continued)

(58) Field of Classification Search
CPC ..... E02F 3/3402; E02F 3/3405; E02F 3/38; E02F 3/42; E02F 9/0083; E02F 9/16
See application file for complete search history.

(56) References Cited

U.S. PATENT DOCUMENTS 3,982,648 A * 9/1976 Luedtke ..... E02F 9/24 414/697
5,015,148 A * 5/1991 Johnson ..... E02F 3/3408 414/722

(Continued)

FOREIGN PATENT DOCUMENTS

CN 2513872 Y 10/2002
CN 102285327 A 12/2011

(Continued)

*Primary Examiner* — Saul Rodriguez
*Assistant Examiner* — Brendan P Tighe
(74) *Attorney, Agent, or Firm* — Bayramoglu Law Offices LLC

(57) ABSTRACT

A skid steer loader includes a chassis frame, a cab, a main beam, and a bucket. The chassis frame is assembled with a walking system to form a movable chassis of the skid steer loader, and a power system of the skid steer loader is assembled to a tail portion of the chassis frame. The cab is arranged on a front portion of the chassis frame in an. overturning manner, and the cab is horizontally placed on the chassis frame when a telescopic support rod is in a retracted state and overturns forward when the telescopic support rod is in an extended state. A tail end of the main beam is movably hinged to the tail portion of the chassis frame by a four-bar linkage mechanism, the bucket is assembled to a front end of the main beam.

10 Claims, 11 Drawing Sheets

(51) Int. Cl.
*E02F 3/42* (2006.01)
*E02F 9/08* (2006.01)
*E02F 9/16* (2006.01)

(52) U.S. Cl.
CPC ..... *E02F 3/42* (2013.01); *E02F 9/0883* (2013.01); *E02F 9/16* (2013.01)

(56) References Cited

U.S. PATENT DOCUMENTS 5,042,602 A * 8/1991 Nakatani ..... B60K 11/04 165/41
5,634,762 A * 6/1997 Kim ..... E02F 3/388 212/292
5,941,330 A * 8/1999 Miller ..... E02F 9/166 180/328
2004/0148816 A1* 8/2004 Watanabe ..... E02F 9/24 37/347
2005/0264038 A1* 12/2005 Albright ..... E02F 9/166 296/190.05
2016/0090711 A1* 3/2016 Sumiyoshi ..... E02F 9/02 296/190.08
2019/0242093 A1 8/2019 Handel et al.
2019/0368162 A1 12/2019 Agnew et al.
2021/0285183 A1* 9/2021 Horii ..... E02F 3/384
2022/0009564 A1* 1/2022 Hatta ..... E02F 3/963

FOREIGN PATENT DOCUMENTS

CN 102817384 A 12/2012
CN 103786784 A 5/2014
CN 109296443 A 2/2019
JP 2018119457 A * 8/2018
WO 2019179718 A1 9/2019

* cited by examiner

SKID STEER LOADER

CROSS REFERENCE TO RELATED APPLICATIONS

This application is the national phase entry of International Application No. PCT/CN2019/126626, filed on Dec. 19, 2019, which is based upon and claims priority to Chinese Patent Application No. 201911241020.7, filed on Dec. 6, 2019; the entire contents of which are incorporated herein by reference.

TECHNICAL FIELD

The present invention belongs to a loading device, and in particular, relates to a skid steer loader.

BACKGROUND

A skid steer loader is a small-sized loading machine for implementing vehicle steering by using a linear velocity difference between wheels on two sides. The skid. steer loader usually includes a chassis frame, a hydraulic walking system, a cab, a power system, an electro-hydraulic control system, a working apparatus, and the like. Skid steer loaders are mainly applied to scenarios with a narrow operating site, uneven ground, or frequent switching between different tasks.

At present, the skid steer loader has the main problems of relatively large noise; difficulty in daily disassembly and maintenance because the cab, the power system, the walking system, and the electro-hydraulic control system of the loader are all integrated and assembled to the chassis frame, the structure is very compact, and fields of view of the components assembled inside the loader are limited; and lower loading and lifting capabilities than that of a general-purpose loader.

SUMMARY

Technical Problem

The technical problem to be resolved in the present invention is to provide a new skid steer loader for the problem of poor working efficiency caused by difficult disassembly and maintenance of an existing skid steer loader.

Technical Solution

The present invention is implemented by the following technical solutions:

A skid steer loader is provided, including a chassis frame 1, a cab 2, a main beam 3, and a bucket 4.

The chassis frame 1 is assembled with a walking system to form a movable chassis of the skid steer loader, and a power system of the skid steer loader is assembled to a tail portion of the chassis frame 1.

The cab 2 is arranged on a front portion of the chassis frame 1 in an overturning manner, one side of the bottom of the cab 2 is fixedly hinged to the chassis frame 1, the other side of the bottom of the cab is supported and connected to the chassis frame 1 at a position other than the hinged position by a telescopic support rod 26, and the cab 2 is horizontally placed on the chassis frame 1 when the telescopic support rod 26 is in a retracted state and overturns forward when the telescopic support rod 26 is in an extended state, to expand an inspection space between the cab and the power system.

A tail end of the main beam 3 is movably hinged to the tail portion of the chassis frame 1 by a four-bar linkage mechanism 31, the bucket 4 is assembled to a front end of the main beam 3, a loading and unloading oil cylinder 51 for driving loading and unloading is assembled between the bucket 4 and the main beam 3, and a lifting oil cylinder 52 for driving the main beam to swing up and down to lift and lower the bucket is assembled between the main beam 3 and the chassis frame 1.

Further, two groups of main beams 3 are arranged on two sides of the cab 2 in parallel, the two groups of main beams 3 are integrally connected by horizontal connectors located at front and rear positions of the cab 2, front ends of the two groups of main beams 3 are connected to the bucket 4 by two groups of synchronized loading and unloading oil cylinders 51, tail ends of the two groups of main beams are movably hinged to the chassis frame 1 by four-bar linkage mechanisms 31, and two groups of synchronized lifting oil cylinders 52 are arranged between the chassis frame 1 and the two groups of main beams 3.

Further, a top of the bucket 4 and the horizontal connector in front of the cab 2 are respectively provided with pedals, and the pedals form an access passage of the cab 2.

Further, the four-bar linkage mechanism 31 includes a swing frame 311, a rear connecting rod 312, and a front connecting rod 313, the swing frame 311 is fixed to the tail end of the main beam 3, two hinge points arranged on the swing frame are respectively hinged to the rear connecting rod 312 and the front connecting rod 313, the rear connecting rod 312 and the front connecting rod 313 are respectively fixedly hinged to two hinge point positions on the chassis frame 1, the rear connecting rod 312 is located behind the front connecting rod 313, a hinge point position of the rear connecting rod on the chassis frame 1 is higher than a hinge point position of the front connecting rod, and a length of the rear connecting rod is less than that of the front connecting rod.

One end of the lifting oil cylinder 52 is fixedly hinged to the chassis frame 1, and the other end of the lifting oil cylinder is hinged to a third hinge point position on the swing frame 311.

Further, the lifting oil cylinder 52 is perpendicular to the main beam 3 when the bucket 4 is lowered to a lowest position.

Further, a ratio of a distance between the hinge points of the swing frame 311 with the rear connecting rod 312 and the front connecting rod 313 to a distance between hinge points on two ends of the rear connecting rod 312 to a distance between the hinge points of the chassis frame 1 with the rear connecting rod 312 and the front connecting rod 313 to a distance between hinge points on two ends of the front connecting rod 313 is 12:11:18:16.

Further, a cab safety rod 25 is arranged on the telescopic support rod 26, the cab safety rod 25 is a hollow sleeve rod and is freely sleeved on the telescopic support rod 26 the cab safety rod and a small diameter end of the telescopic support rod 26 are hinged and assembled to a same hinge point, and an axial length of the cab safety rod does not exceed a length of a small diameter rod of the telescopic support rod.

Further, a main beam safety rod 34 is arranged on the main beam 3, one end of the main beam safety rod 34 is hinged to a hinge point of the main beam 3 and the lifting oil cylinder 52, and a safety rod fixing plate 35 for detachably fixing the main beam safety rod 34 is arranged at a position at which the hinge point is close to the front end of the main beam. The main beam safety rod 34 is provided with a through groove for accommodating a piston rod of the lifting oil cylinder 52, a length of the through groove corresponds to an extending length of the piston rod of the lifting oil cylinder 52, and when the main beam 3 controls the bucket 4 to be in a lifted state, the main beam safety rod 34 swings to cover the piston rod of the lifting oil cylinder 52, and an end portion of the main beam safety rod abuts against an end portion of a cylinder barrel of the lifting oil cylinder 52, to prevent the piston rod of the lifting oil cylinder from retracting into the cylinder barrel.

Further, the tail portion of the chassis frame 1 is divided into a left frame 11 and a right frame 12, and concave spaces are respectively formed inside the left frame 11 and the right frame 12 for fixedly embedding a hydraulic oil tank module 61 and a fuel tank module 62 of the power system.

Further, the power system on the chassis frame 1 is integrated and assembled between the left frame 11 and the right frame 12, the left frame 11 and the right frame 12 are connected by a left and right frame connector 74, an air filter element 73 is fixedly arranged on the left and right frame connector 74, an air inlet of the air filter element 73 is connected to an air inlet connecting pipe 71 arranged on the frame on one side by an air inlet guide pipe 72, and an air outlet of the air filter element is connected to an air inlet unit of the power system by a pipe.

An exhaust port of the power system is connected to an exhaust tail pipe 76 by an exhaust flange pipe 75, and the exhaust tail pipe 76 is fixed by a tail pipe support 77 on the frame on the other side and extends out of a top middle cover.

Further, a heat dissipation water tank 81 of the power system is assembled between the left frame 11 and the right frame 12, one side of the heat dissipation water tank 81 is hinged to a tail portion of the frame on one side, a water tank lock pin 83 arranged on the other side of the heat dissipation water tank 81 is inserted into a bolt limiting block 84 on the frame on the other side, to lock and assemble the heat dissipation water tank, engagement of the water tank lock pin 83 with the bolt limiting block 84 is released, and the heat dissipation water tank 81 is opened outward to expose the internal power system.

An air guide cover 85 covering an entire cross section of the heat dissipation water tank is arranged on an inner side of the heat dissipation water tank 81, and the air guide cover 85 is engaged with an air outlet of a heat dissipation fan 86 of the power system when the heat dissipation water tank 81 is in a locked state.

A cooling water channel and a hydraulic oil channel are provided inside the heat dissipation water tank 81, an engine upper water pipe 91 and an engine lower water pipe 92 of the power system are respectively engaged with two ends of the cooling water channel, and hydraulic oil in a hydraulic return pipe of the power system flows back into a hydraulic oil tank through the hydraulic oil channel.

Beneficial Effects

The present invention has the following beneficial effects.

1. According to the skid steer loader of the present invention, the four-bar linkage mechanism cooperates for lifting the main beam and the bucket, and an approximately vertical lifting path is achieved. The hinge points of the four-bar linkage mechanism are arranged, and the lifting oil cylinder pushes the main beam at an angle of approximately 90°, so that the skid steer loader has more reliable working efficiency. Compared with a general circular-arc lifting-type working apparatus, in the skid steer loader, a smaller dr g oil cylinder may be arranged under a same loading capacity, and the skid steer loader may obtain a longer unloading distance and unloading height under a same driving force and driving distance, thereby greatly improving the working capability of the skid steer loader.

The lifting oil cylinder may pass through the hollow front connecting rod, to effectively shorten widths of machines on a left side and a right side of the skid steer loader. A ratio relationship between lengths of connecting rods of the four-bar linkage mechanism is optimized, so that the entire bucket tends to rise vertically in terms of the movement track, and obtains a specific extra forward unloading distance when being at a maximum height. Meanwhile, the lifting dynamic performance of the entire bucket is improved, the entire lifting process is fast and stable with small acceleration fluctuation, the load material is not prone to failing, and the operation comfort is high.

2. The skid steer loader of the present invention adopts a cab that can be overturned, and the entire cab can be overturned and opened by only one person. Through the limitation of the cab safety rod, the entire cab may remain fixed after being overturned. An inspection and maintenance area inside the chassis frame is increased by overturning the cab, to provide convenience for inspection and maintenance of the power system.

3. A main beam safety rod structure is arranged on the main beam of the present invention. The main beam safety rod structure may be folded and fixed when a machine works normally. In some specific cases, for example, when the machine is shut down for a long time for maintenance or when the machine is stopped in a small space and the bucket needs to be lifted, the safety rod is lowered to lock the lifting oil cylinder, to avoid falling of the bucket and the main beam caused by falling of the oil cylinder and avoid the danger of damage to personnel and items.

4. The skid steer loader of the present invention adopts the detachable fuel tank and hydraulic oil tank. Compared with an entirely welded oil tank, failure of antirust processing (failure of surface pickling and phosphating) on an inner surface of the oil tank due to welding may be avoided. The hydraulic oil tank and the fuel tank are embedded in concave spaces of the chassis frame, to save a mounting space of the chassis frame, thereby making arrangement of the power system more compact.

5. In the skid steer loader of the present invention, high temperature inside a cabin of the engine of the power system and poor ventilation of the closed cabin are considered. If air is directly selected to enter the cabin of the engine, an air intake temperature is excessively high, and the thermal balance performance of the machine is affected, thereby affecting the working efficiency and the service life of the machine. In the present invention, the air inlet guide pipe is additionally arranged on the engine of the power system, and external fresh air is introduced through an air duct arranged inside the chassis frame, so that the air intake temperature can be effectively prevented from increasing. In addition, in the present invention, a relatively large vibration amplitude of the engine at a moment of starting is further considered. If an extended direct-connected exhaust tail pipe is used or an exhaust corrugated pipe is added in the middle, cracking of the exhaust tail pipe or the exhaust corrugated pipe may be caused by vibration, the exhaust tail pipe is connected by an exhaust flange pipe, the vibration of the engine does not affect the exhaust tail pipe, and the cost of the exhaust corrugated pipe is saved.

6. According to the skid steer loader provided in the present invention, a water tank that can be overturned and opened is arranged at the tail portion of the chassis frame, and may be in contact with the internal space of the power system after being opened, so that the maintenance convenience of the machine is greatly improved. For example, a filter element is replaced, daily maintenance is performed, fan blades of the engine are replaced, the water tank is cleaned and flushed, and engine oil is replaced.

Based on the foregoing, compared with an existing load device, the skid steer loader of the present invention has the advantages of convenient disassembly and maintenance, reliable work, and a compact structure.

The present invention is further described below with reference to the accompanying drawings and specific implementations.

REFERENCE NUMERALS

1. Chassis frame, 11. Left frame, 111-Concave space for mounting a hydraulic oil tank, 12. Right frame, 121. Concave space for mounting a fuel tank, 122. Fuel tank fixing plate, 13, Tail gate, 131, Tail baffle plate, and 132. Tail reinforcing plate;

2. Cab, 21. First pedal, 22. Second pedal, 23. Fixed base in front of a cab, 24.

Overturn pin shaft, 25. Cab safety rod, 26. Telescopic support rod, 27. Upper support base, 28. Lower support base, and 29. Handle;

3. Main beam, 31. Four-bar linkage mechanism, 311. Swing frame, 312. Rear connecting rod, 313. Front connecting rod, 32. Rear horizontal connector, 33. Front horizontal connector, 34. Main beam safety rod, 35. Safety rod fixing plate, and 351. Safety rod fixing pin;

4. Bucket, 41. Front reinforcing plate, 42. Side reinforcing plate, 43. Upper reinforcing plate, and 44. Rear reinforcing plate;

51. Loading and unloading oil cylinder, and 52. Lifting oil cylinder;

61. Hydraulic oil tank module, 611. Hydraulic oil tank fixing plate, and 62. Fuel tank module;

71. Air inlet connecting pipe, 72. Air inlet guide pipe, 73. Air filter element, 74. Left and right frame connector, 75. Exhaust flange pipe, 76. Exhaust tail pipe, 77. Tail pipe support, and 78. Middle cover;

81. Heat dissipation water tank, 82. Water tank mounting hinge, 83. Water tank lock pin, 84. Bolt limiting block, 85. Air guide cover, 86. Heat dissipation fan, and 87, Protection cover; and 91. Engine upper water pipe, 92. Engine lower water pipe, 93. Oil inlet pipe, and 94. Oil return pipe.

DETAILED DESCRIPTION OF THE EMBODIMENTS

Embodiment 1

Figure 1:
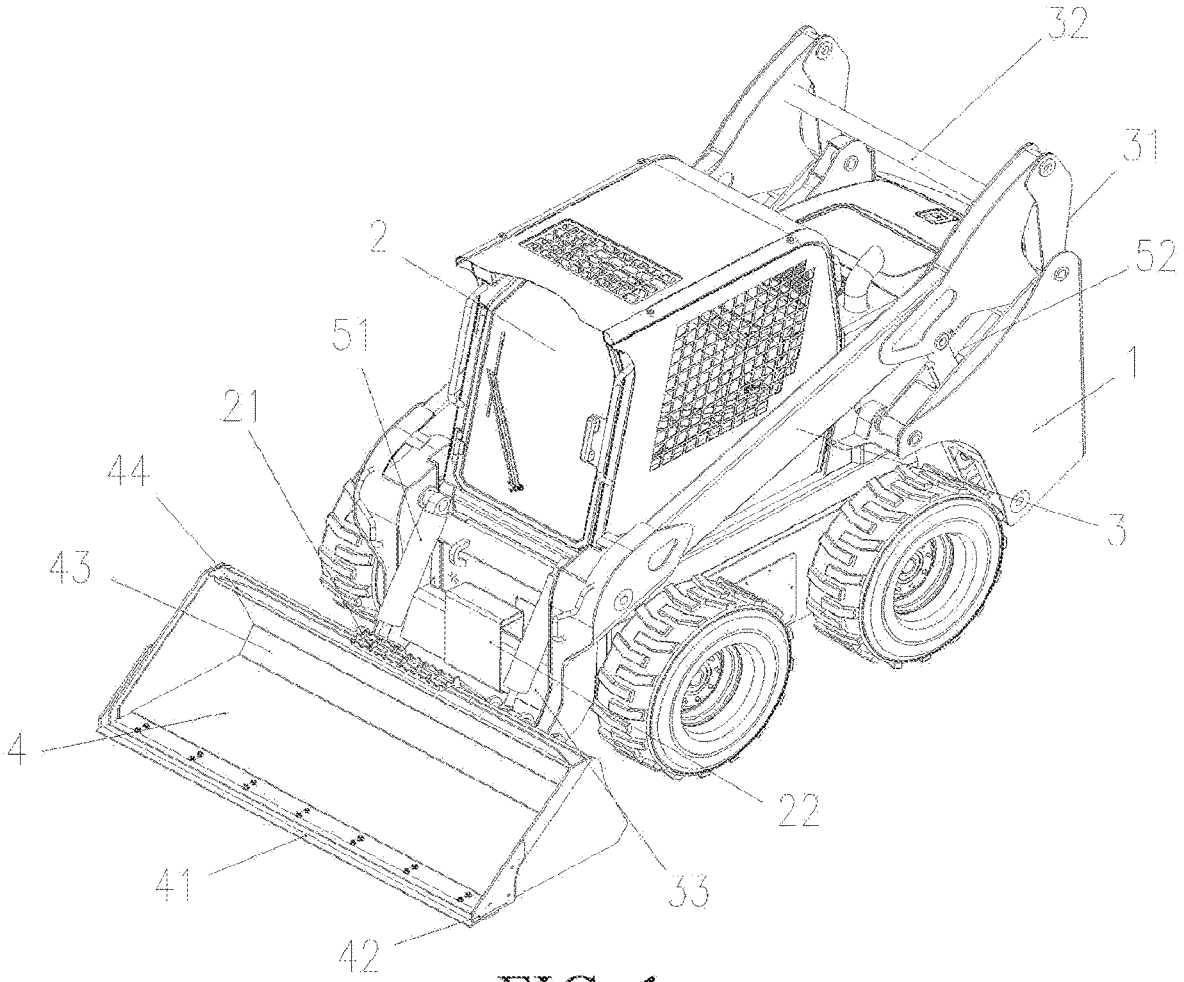
FIG. 1 is a three-dimensional schematic diagram of a skid steer loader in Embodiment 1.
Figure 2:
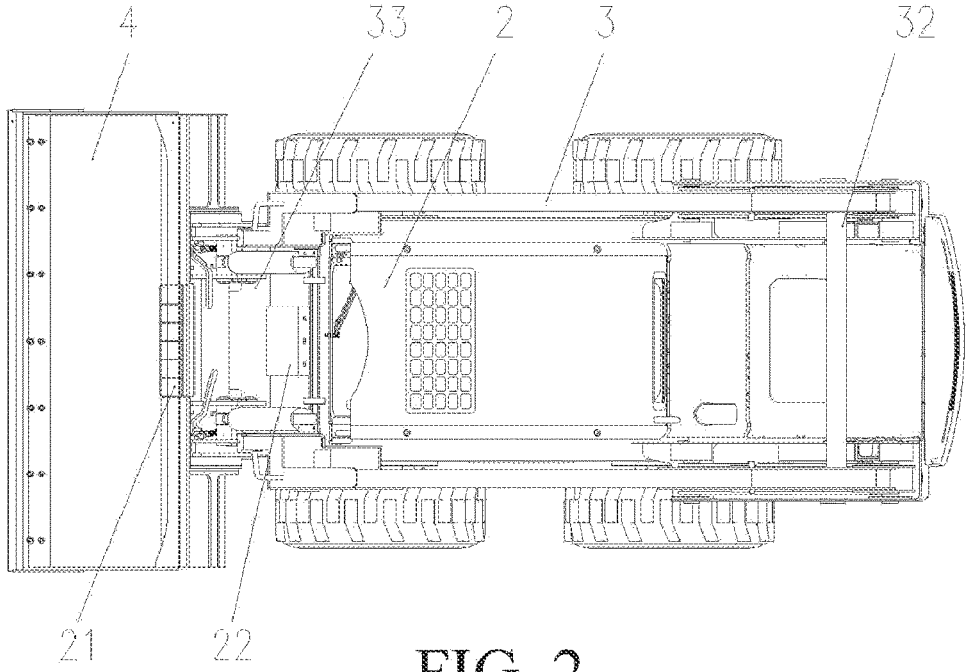
FIG. 2 is a top view of the skid steer loader in Embodiment 1.
Figure 3:
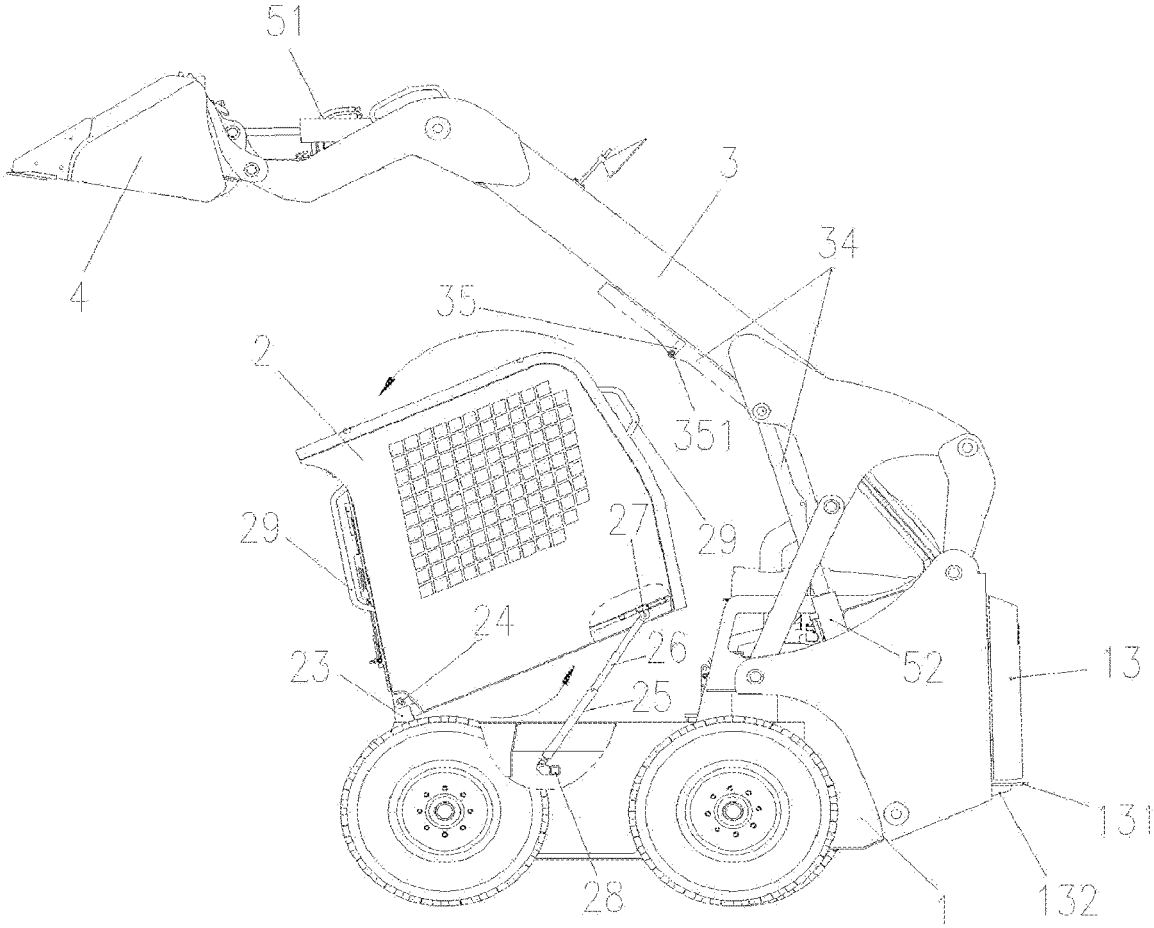
FIG. 3 is a main view of the skid steer loader in Embodiment 1, where in the figure, a cab of the skid steer loader is in an overturned state, and a bucket is in a lifted state.

Referring to FIG. 1 to FIG. 3, a skid steer loader in the figures is a specific implementation of the present invention and specifically includes a chassis frame 1, a cab 2, a main beam 3, a bucket 4, a loading and unloading oil cylinder 51, a lifting oil cylinder 52, a power system not shown in the figure, and the like. The chassis frame 1 is assembled with a wheeled walking system to form a movable chassis of the skid steer loader. The power system of the skid steer loader is assembled to a tail portion of the chassis frame 1. The wheeled walking system has four wheels and is controlled by an independent hydraulic motor, and walking and steering functions of the skid steer loader may be implemented by using a speed difference between wheels on two sides. The power system includes an engine system and a hydraulic system for providing a driving force to each action part of the skid steer loader. The cab 2 is arranged on a front portion of the chassis frame 1 in an overturning manner and is configured for a driver to operate the skid steer loader to work. The main beam 3 is connected to the bucket 4 and the chassis frame 1, and the main beam 3 swings to transmit a lifting power to the bucket 4. A tail end of the main beam 3 is movably hinged to the tail portion of the chassis frame 1 by a four-bar linkage mechanism 31. The bucket 4 is assembled to a front end of the main beam 3, and the bucket 4 is lifted and lowered in front of the cab of the skid steer loader under the drive of the main beam 3. The loading and unloading oil cylinder 51 is assembled between the bucket 4 and the main beam 3, and the loading and unloading oil cylinder 51 drives the bucket 4 to load and unload material. The lifting oil cylinder 52 is assembled between the main beam 3 and the chassis frame 1, and the lifting oil cylinder 52 drives the main beam 3 to swing up and down to lift and lower the bucket 4. Both the loading and unloading oil cylinder 51 and the lifting oil cylinder 52 are driven by the hydraulic system of the power system.

For the wheeled walking system and power system in this embodiment, reference may be made to the existing skid steer loader. Details are not described in this embodiment again.

Figure 10:
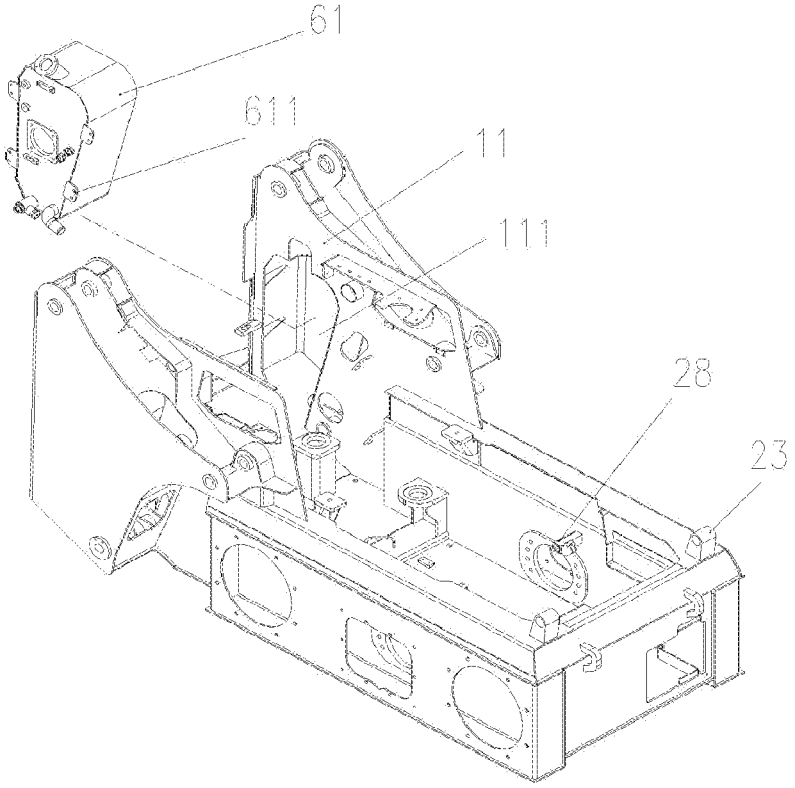
FIG. 10 is a schematic diagram in which a chassis frame of the skid steer loader is assembled with a hydraulic oil tank module in Embodiment 1.
Figure 11:
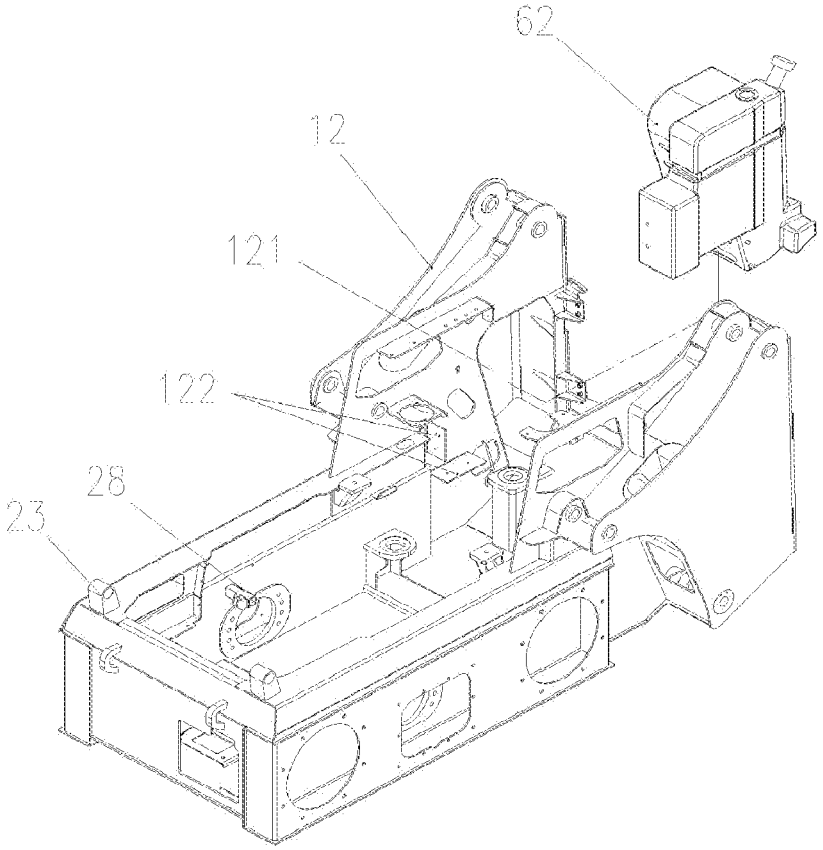
FIG. 11 is a schematic diagram in which the chassis frame of the skid steer loader is assembled with a fuel tank module in Embodiment 1.

Referring to FIG. 3, FIG. 10, and FIG. 11, one side of the bottom of the cab 2 is fixedly hinged to the chassis frame 1. Two groups of fixed bases 23 in front of the cab are welded and fixed to two sides of the front portion of the chassis frame 1, and two sides of the bottom of the cab 2 are respectively hinged to the fixed bases 2.3 in front of the cab by two groups of overturn pin shafts 24. Upper support bases 27 are welded to both two rear sides of the bottom of the cab 2, and two groups of lower support bases 28 are welded and fixed to a lower middle portion of the chassis frame 1. The upper support base 27 and the lower support base 28 that are on a same side are connected by a telescopic support rod 26, and the telescopic support rod 26 supports and connects the bottom of the cab 2 and the chassis frame 1. When the skid steer loader works normally, the cab 2 is horizontally placed on the chassis frame 1 as a whole, and the telescopic support rod 26 is in a compressed state. The driver can enter and exit the cab 2 to normally operate the skid steer loader. When the loader needs to be inspected, the cab 2 may be overturned forward by using handles 29 arranged on front and rear sides of the cab 2, and the telescopic support rod 26 is adjusted into a stretched state, to support, and limit an overturned state of the cab 2. The overturned cab 2 expands an inspection space between the cab 2 and the power system on the tail portion of the chassis frame.

Figure 4:
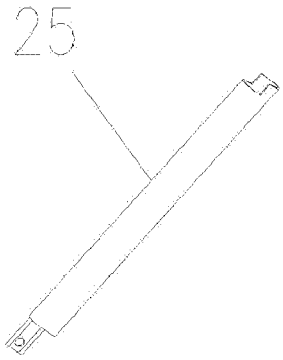
FIG. 4 is a schematic diagram of a cab safety rod.

The telescopic support rod 26 is a pneumatic telescopic support rod and includes an air cylinder barrel with a relatively large diameter and a support rod with a relatively small diameter. The cab is supported by using compressed air inside the air cylinder barrel. To improve reliability of the overturned state of the cab 2, in this embodiment, the telescopic support rod 26 below the cab 2 is provided with a cab safety rod 25. With reference to FIG. 3 and FIG. 4, the cab safety rod 25 is a cylindrical hollow sleeve rod and can be freely sleeved on the telescopic support rod 26. An inner diameter of the cab safety rod is slightly greater than the diameter of the air cylinder barrel of the telescopic support rod 26. One end of the cab safety rod and the support rod of the telescopic support rod 26 are hinged and assembled to a same hinge point. An axial length of the cab safety rod 25 does not exceed an extending length of the support rod of the telescopic support rod. When the telescopic support rod 26 is in a retracted state, the cab safety rod 25 is sleeved outside the air cylinder barrel of the telescopic support rod 26. When the telescopic support rod 26 is in a stretched and extended state, the cab safety rod 25 is sleeved outside the support rod of the telescopic support rod 26. After the support rod completely extends out of the air cylinder barrel, a step on an end portion of the cab safety rod 25 abuts against an end portion of a step of the air cylinder barrel, to prevent the support rod from retracting into the air cylinder barrel, thereby achieving an effect of fixing the cab in the overturned state.

As shown in FIG. 3, when the skid steer loader of this embodiment is inspected, the main beam 3 needs to be further controlled to swing upward to lift the bucket 4 to expose an upper space of the power system on the tail portion. In this case, the lifting oil cylinder 52 of the main beam 3 is controlled to be in a stretched state. In this embodiment, a main beam safety rod 34 is also arranged on the main beam 3 to avoid potential safety hazard caused by retracting of the lifting oil cylinder 52 due to failure.

Figure 5:
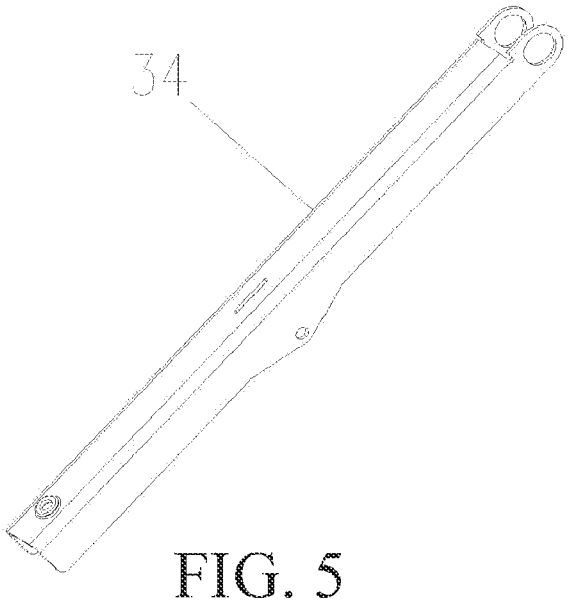
FIG. 5 is a schematic diagram of a main beam safety rod.

Referring to FIG. 5, the main beam safety rod 34 is a strip-shaped structure with a through groove. One end of the main beam safety rod 34 is hinged to a hinge point of the main beam 3 and the lifting oil cylinder 52. The hinge point is hinged to a piston rod of the lifting oil cylinder 52. A safety rod fixing plate 35 for fixing the main beam safety rod 34 is arranged at a position at which the hinge point is close to the front end of the main beam. When the skid steer loader works normally, the main beam safety rod 31 swings into the safety rod fixing plate 35, and a safety rod fixing pin 351 passes through the main beam safety rod 34 and the safety rod fixing plate 35 to fix the main beam safety rod and the safety rod fixing plate. The safety rod fixing pin 351 is limited by using a cotter, so that the main beam safety rod 34 is detachably fixed in the safety rod fixing plate 35. When the main beam 3 is lifted for inspection, the main beam safety rod 34 is removed from the safety rod fixing plate 35 and swings downward. The through groove on the main beam safety rod 34 can accommodate the piston rod of the lifting oil cylinder 52, and a length of the through groove corresponds to an extending length of the piston rod of the lifting oil cylinder 52. In this case, the main beam safety rod 34 swings to cover the piston rod of the lifting oil cylinder 52. An end portion of the main beam safety rod 34 abuts against an end portion of a cylinder barrel of the lifting oil cylinder 52, to prevent the piston rod of the lifting oil cylinder from retracting into the cylinder barrel. In this case, the entire lifting oil cylinder 52 is rigidly supported by using the main beam safety rod 34, to avoid potential safety hazard caused by downward swinging of the main beam.

Referring to FIG. 1 and FIG. 2 again, two main beams 3 are arranged on the skid steer loader of this embodiment. The two main beams 3 are arranged on two sides of the cab 2 in parallel, and the two groups of main beams 3 are connected by a rear horizontal connector 32 and a front horizontal connector 33 respectively located at rear and front positions of the cab 2. Two ends of the rear horizontal connector 32 and two ends of the front horizontal connector 33 are welded to connect the two main beams 3 as a whole, to form a main beam frame. A support is formed by welding a front sealing plate on front ends of the two groups of main beams 3, and two groups of synchronized loading and unloading oil cylinders 51 are connected to two ends of the bucket 4, to reliably drive the bucket 4. Tail ends of the two main beams 3 are movably hinged to the chassis frame 1 by the four-bar linkage mechanism 31, and two groups of synchronized lifting oil cylinders 52 are arranged between the chassis frame 1 and the two groups of main beams 3.

Specifically, as shown in FIG. 1, a reinforcing structure is arranged on the bucket 4 of the skid steer loader and includes a front reinforcing plate 41, side reinforcing plates 42, an upper reinforcing plate 43, and a rear reinforcing plate 44. The front reinforcing plate 41 and the side reinforcing plates 42 are steel plates made of wear-resistant materials and are mounted on a side wall of a front end of the bucket and two sides of the bucket 4 by using bolts. The upper reinforcing plate 43 and the rear reinforcing plate 44 are respectively welded and fixed to the top and the bottom of the bucket 4. The front reinforcing plate 41 and the side reinforcing plates 42 are rapidly worn and are detachable and replaceable.

In this embodiment, an access door is arranged on a front side surface of the cab 2, A first pedal 21 is arranged on the top of the bucket 4, and a second pedal 22 is arranged on the front horizontal connector 33 in front of the cab 2. The arrangement of the pedals requires no interference with the cab during swing of the main beam. The pedals adopt pattern steel plate or saw-tooth-shaped steel plate structures. When the bucket 4 is lowered to a lowest position, two stages of pedals form an access passage of the cab 2, and a driver may enter and exit the cab from the front side surface of the cab 2 through the access passage.

Figure 6:
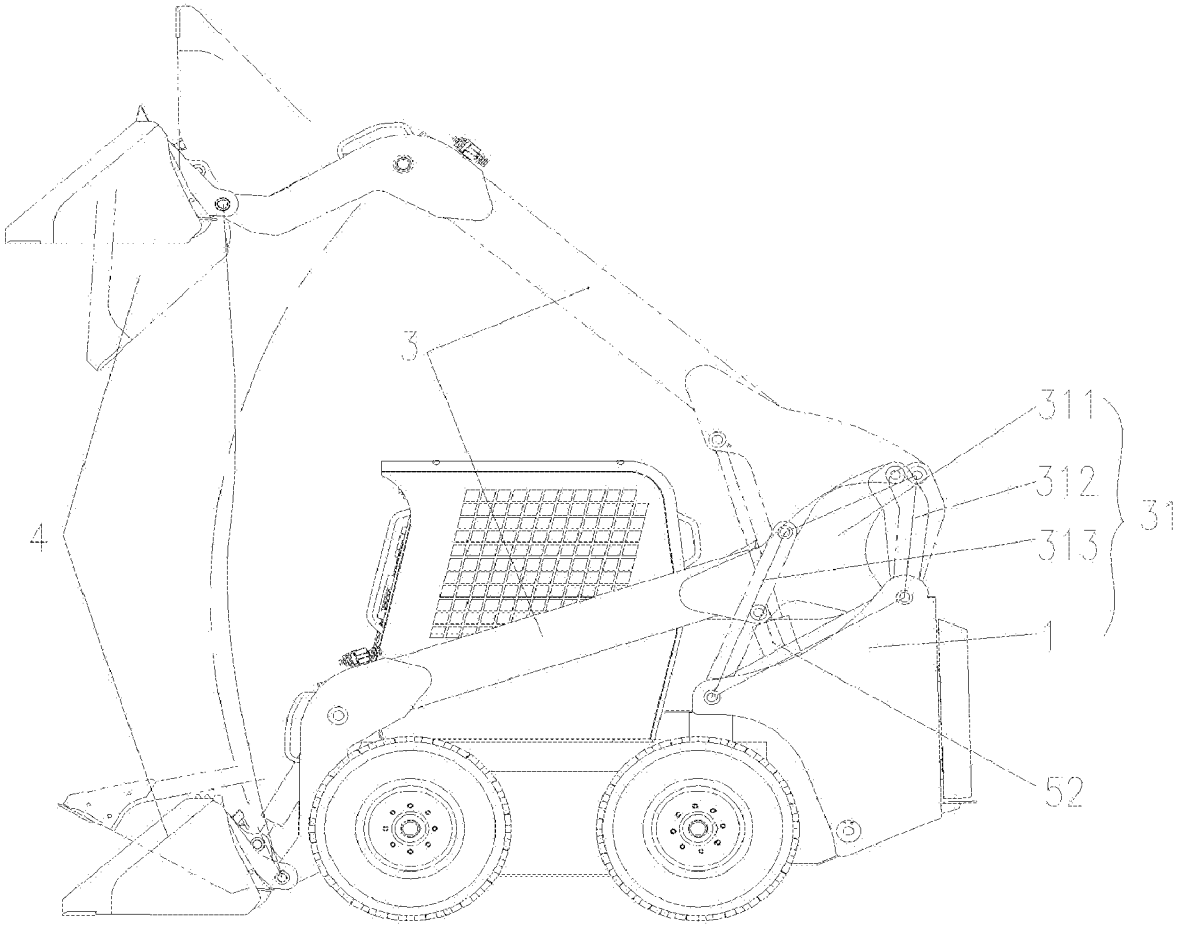
FIG. 6 is a schematic diagram of a movement route when a bucket of the skid steer loader is lifted in Embodiment 1.
Figure 7:
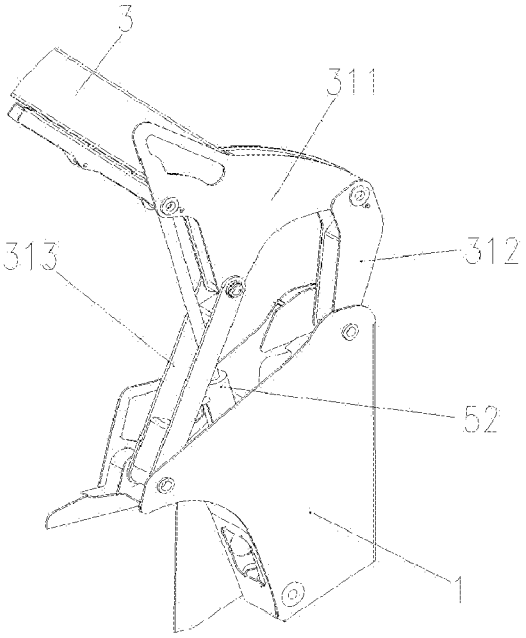
FIG. 7 is a partial schematic diagram of a four-bar linkage mechanism of the skid steer loader in Embodiment 1.
Figure 8:
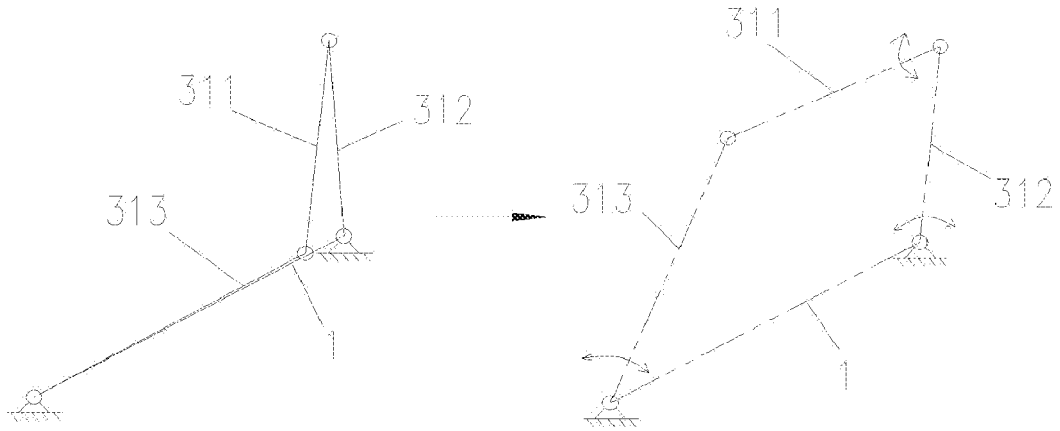
FIG. 8 is a schematic diagram of a mechanism motion of the four-bar linkage mechanism of the skid steer loader in Embodiment 1.

Referring to FIG. 6 and FIG. 7, in this embodiment, the four-bar linkage mechanism 31 includes a swing frame 311, a rear connecting rod 312, and a front connecting rod 313. The swing frame 311 is fixed to the tail end of the main beam and two hinge points arranged on the swing frame are respectively hinged to end portions of the rear connecting rod 312 and the front connecting rod 313. A connecting line between the two hinge points crosses the main beam. The other ends of the rear connecting rod 312 and the front connecting rod 313 are respectively fixedly hinged to two hinge point positions on the chassis frame 1. In this way, the swing frame 311, the rear connecting rod 312, the front connecting rod 313, and the chassis frame form the four-bar linkage mechanism. One end of the lifting oil cylinder 52 is fixedly hinged to the chassis frame 1, the other end of the lifting oil cylinder is hinged to a third hinge point position on the swing frame 311, and the lifting oil cylinder 52 is perpendicular to the main beam 3 when the bucket 4 is lowered to the lowest position. With reference to a schematic diagram of a motion of a four-bar linkage mechanism in FIG. 8, the swing frame 311 is fixed to the main beam driven by the lifting oil cylinder and is a driving member of the four-bar linkage mechanism, and the chassis frame is fixed and is a fixed connecting rod. The swing frame 311 is controlled by using the four-bar linkage mechanism formed by the rear connecting rod 312 and the front connecting rod 313 to swing back and forth during upward swinging of the main beam. Compared with an existing skid steer loader in with a bucket fixedly hinged to a main beam is lifted along a circular arc lifting track, in this embodiment, the bucket at a front end of the main beam is adjusted by using the four-bar linkage mechanism and is lifted along an approximately vertical route. The bucket is closer to a loading device when cargoes are loaded and unloaded and does not need to be moved back and forth when the cargoes are loaded and unloaded to adjust a position.

In the four-bar linkage mechanism of this embodiment, the rear connecting rod 312 is located behind the front connecting rod 313. A hinge point position of the rear connecting rod 312 on the chassis frame 1 is higher than a hinge point position of the front connecting rod on the chassis frame, and a length of the rear connecting rod is less than that of the front connecting rod. The front connecting rod 313 is a hollow connecting rod with a through groove. The lifting oil cylinder 52 passes through the through groove of the front connecting rod 313. In this way, all the hinge points at which the rear connecting rod 312, the front connecting rod 313, and the lifting oil cylinder 52 are respectively hinged to the main beam 3 and the chassis frame are located on a same plane. Extending and retracting of the lifting oil cylinder 52 are controlled, the main beam 3 may be lifted under the impact of the four-bar linkage mechanism 31, the bucket 4 at the front end of the main beam 3 may obtain an approximately vertical lifting path compared with a general circular-arc lifting path, to lift materials and perform carrying.

In this embodiment, a geometric relationship of the four-bar linkage mechanism 31 is specifically optimized, and a ratio of a distance between the hinge points of the swing frame 311 with the rear connecting rod 312 and the front connecting rod 313 to a distance between hinge points on two ends of the rear connecting rod 312 to a distance between the hinge points of the chassis frame 1 with the -a connecting rod 312 and the front connecting rod 313 to a distance between hinge points on two ends of the front connecting rod 313 is set to 12:11:18:16.

Figure 9A:
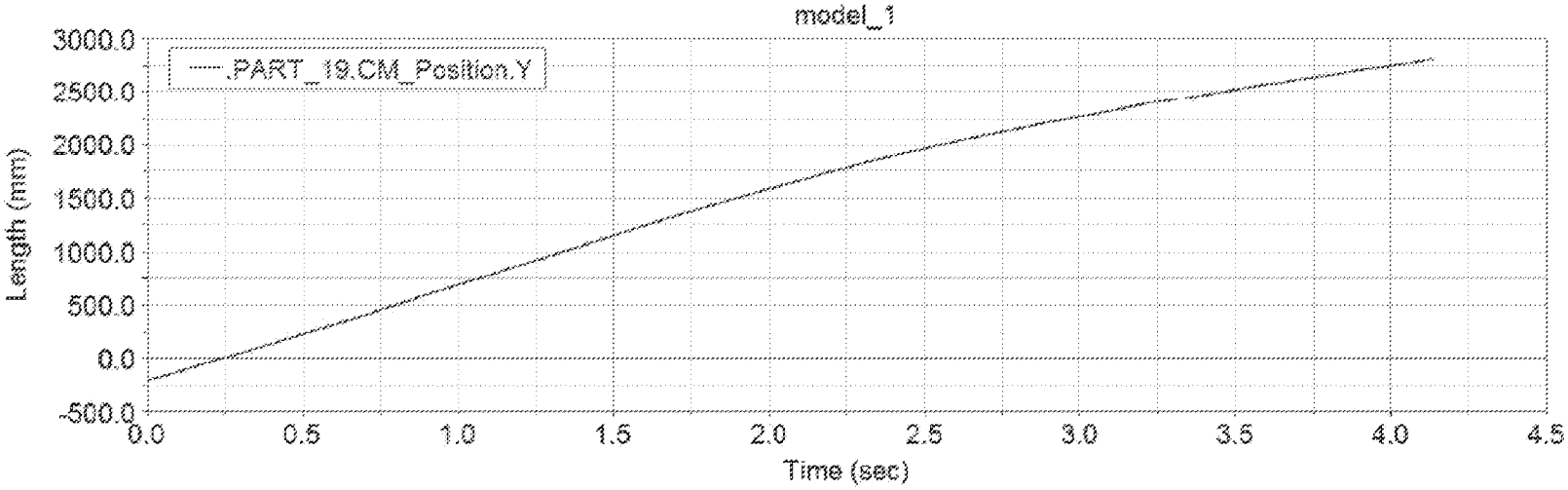
FIG. 9A is a schematic diagram of a displacement-time curve of a bucket of the skid steer loader in Embodiment 1.
Figure 9B:
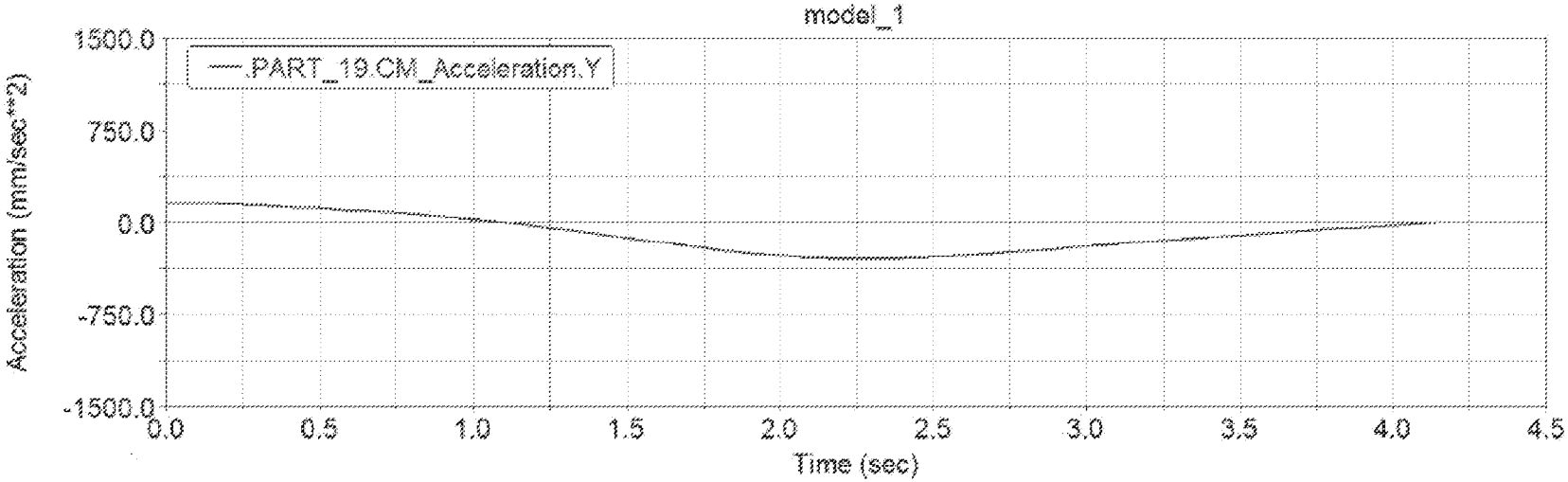
FIG. 9B is a schematic diagram of an acceleration-time curve of a bucket of a skid steer loader in Embodiment 1.
Figure 9C:
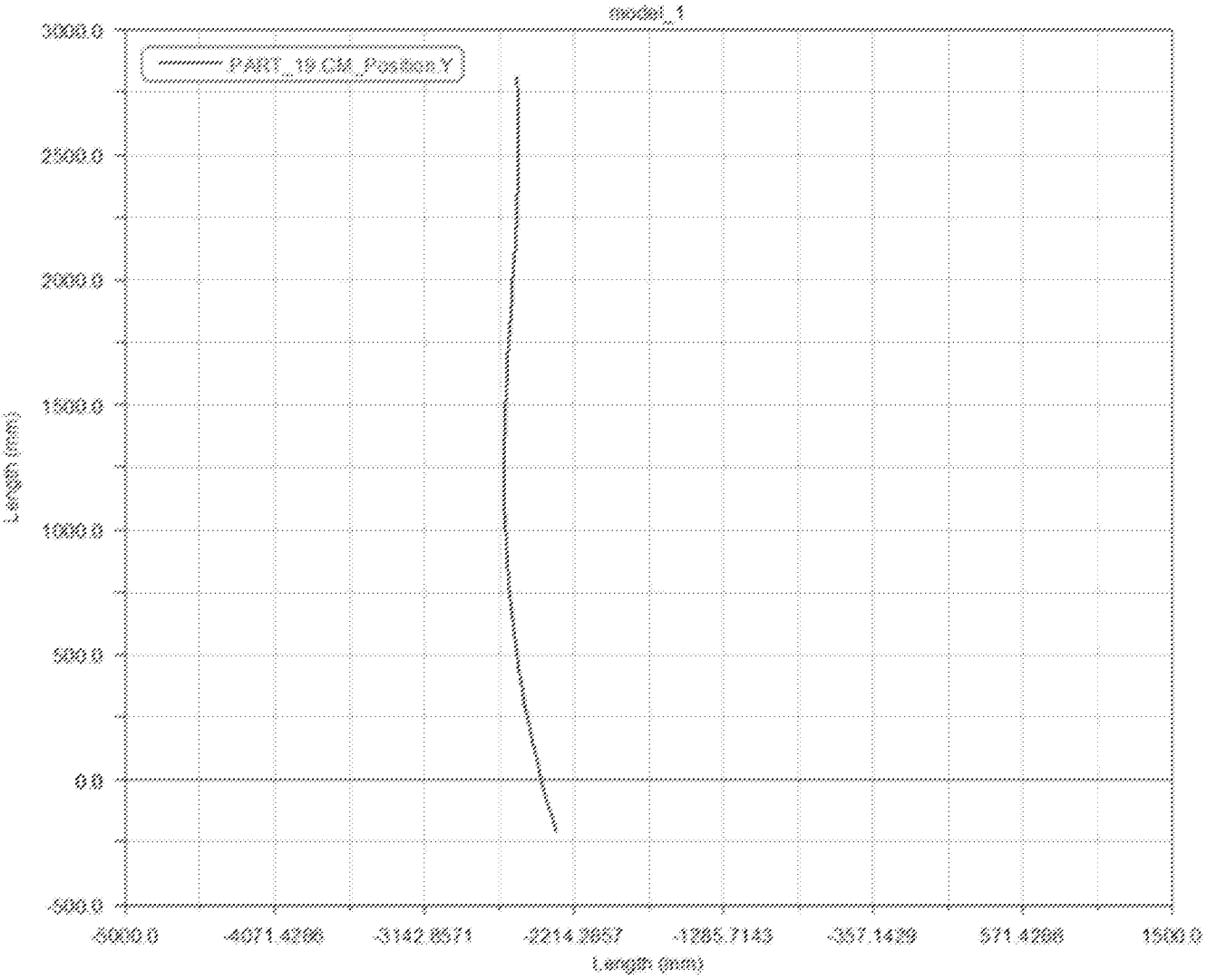
FIG. 9C is a schematic diagram of a lifting path of the bucket of the skid steer loader in Embodiment 1.

With reference to FIG. 9A. FIG. 9B, and FIG. 9C, in a motion simulation process of the four-bar linkage mechanism 31 of this embodiment, a displacement-time curve of the bucket 4 in a vertical direction may be obtained. As shown in FIG. 9A, a lifting speed basically increases proportionally with time, and a speed-displacement curve is stable. As shown in FIG. 9B, an acceleration-time curve of the bucket 4 in the vertical direction is obtained, and fluctuation of acceleration is relatively small relative to a rise time period. It has good practical meaning for reducing impact shaking during material lifting. A change of a lifting path of the bucket 4 in an entire lifting process is analyzed. As shown in FIG. 9C, compared with common circular arc lifting, in this application, the lifting path of the bucket is approximate to vertical rising. Especially near a maximum position, the lifting path of the bucket starts moving forward, which is equivalent to increasing an unloading distance, and the unloading efficiency of the skid steer loader may be further improved after the bucket is lifted to a high position.

Referring to FIG. 10 and FIG. 11, the tail portion of the chassis frame 1 is divided into a left frame 11 and a right frame 12. Four-bar linkage mechanisms of two groups of main beams are respectively arranged on the top of the left frame 11 and the top of the right frame 12. A concave space 111 for mounting a hydraulic oil tank is formed inside the left frame 11 and is configured to fixedly embed a hydraulic oil tank module 61 of the power system. An entire oil tank is formed by welding a hydraulic oil tank fixing plate 611 on an end surface of the hydraulic oil tank module 61, A size of the concave space 111 for mounting a hydraulic oil tank matches an overall size of the entire oil tank. The entire hydraulic oil tank is embedded into the concave space 111 for mounting a hydraulic oil tank of the left frame 11, and the hydraulic oil tank fixing plate 611 is fastened with the left frame 11 through a bolt connection.

A concave space 121 for mounting a fuel tank is formed inside the right frame 12 and is configured to fixedly embed a fuel tank module 62. Fuel tank fixing plates 122 are welded to an outer side wall of the right frame 12. A size of the concave space 121 for mounting a fuel tank matches an overall size of an entire fuel tank. The fuel tank module 62 is embedded into the concave space 121 for mounting a fuel tank of the right frame 12, and the fuel tank module 62 and the fuel tank fixing plates 122 are fastened and mounted in the right frame 12 by using bolts. The space of the chassis frame 1 is fully used to arrange the two groups of oil tanks, thereby saving a mounting space of the power system.

Figure 12:
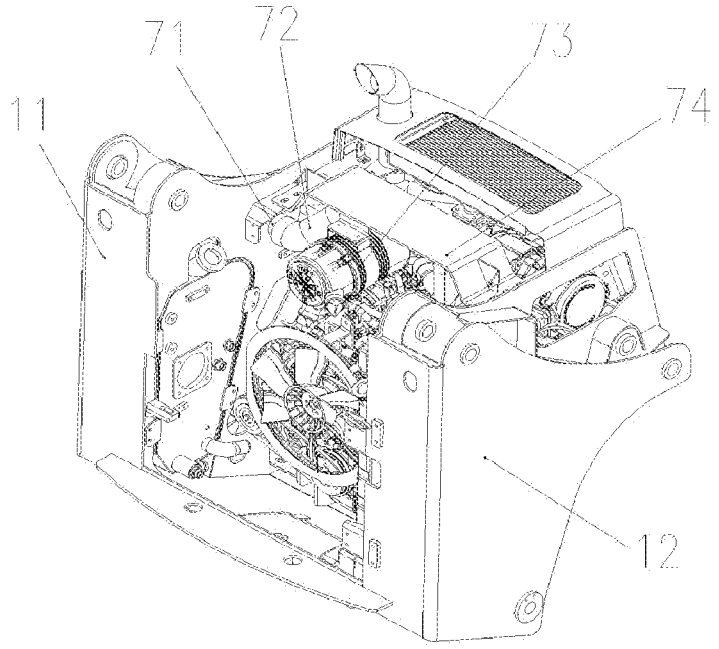
FIG. 12 is a schematic structural diagram of an air inlet pipe of a power system of the skid steer loader in Embodiment 1.
Figure 13:
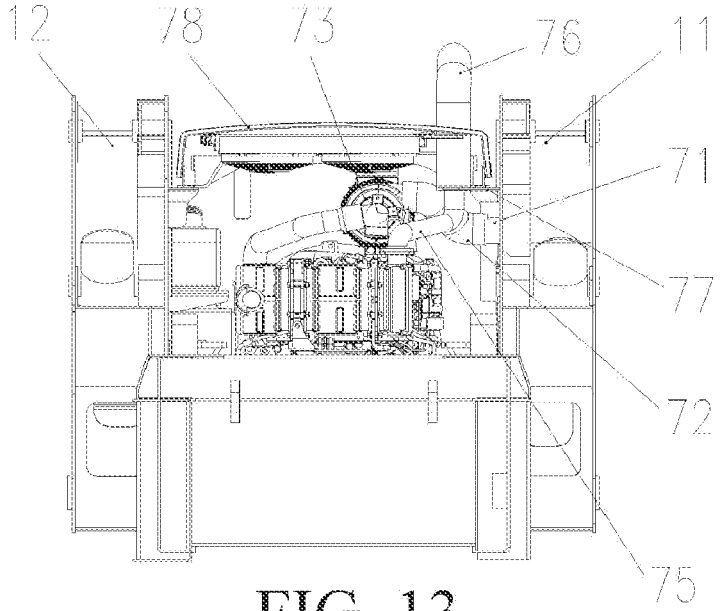
FIG. 13 is a schematic structural diagram of an exhaust pipe of the power system of the skid steer loader in Embodiment 1.

Referring to FIG. 12 and FIG. 13, the power system on the chassis frame 1 is integrated and assembled between the left frame 11 and the right frame 12, and the left frame 11 and the right frame 12 are connected by a left and right frame connector 74. To further optimize air inlet and exhaust pipes of an engine of the power system, in this embodiment, an air filter element 73 of the engine is fixedly mounted on the left and right frame connector 74. An air inlet of the air filter element 73 is connected to an air inlet connecting pipe 71 arranged on the left frame 11 by an air inlet guide pipe 72, and the air inlet connecting pipe 71 is welded in the left frame 11. A plurality of air ducts inside the frame communicate with the outside of a body. An air outlet of the air filter element 73 is connected to an air inlet of the power system by a pipe. External cold air sequentially enters an air inlet of the engine through the air ducts inside the left frame 11, the air inlet connecting pipe 71, the air inlet guide pipe 72, and the air filter element 73, to complete an entire air intake process.

A silencer exhaust port of the engine is connected to an exhaust tail pipe 76 by an exhaust flange pipe 75. The exhaust tail pipe 76 is fixed by a tail pipe support 77 on the right frame 12 and extends out of a top middle cover 78, so that the exhaust tail pipe 76 is separated from the interior of a mounting cabin of the engine. Exhaust gas discharged from the engine is sequentially discharged from the inside of the engine to the outside through the exhaust flange pipe 75 and the exhaust tail pipe 76, to complete an entire exhaust process.

Figure 14:
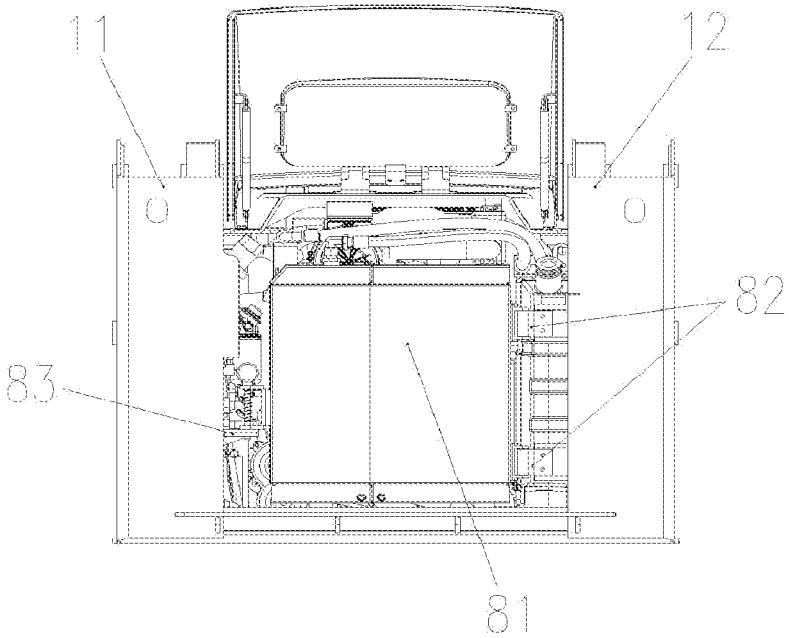
FIG. 14 is a schematic diagram in which a heat dissipation water tank of the skid steer loader is in a closed state in Embodiment 1.
Figure 15:
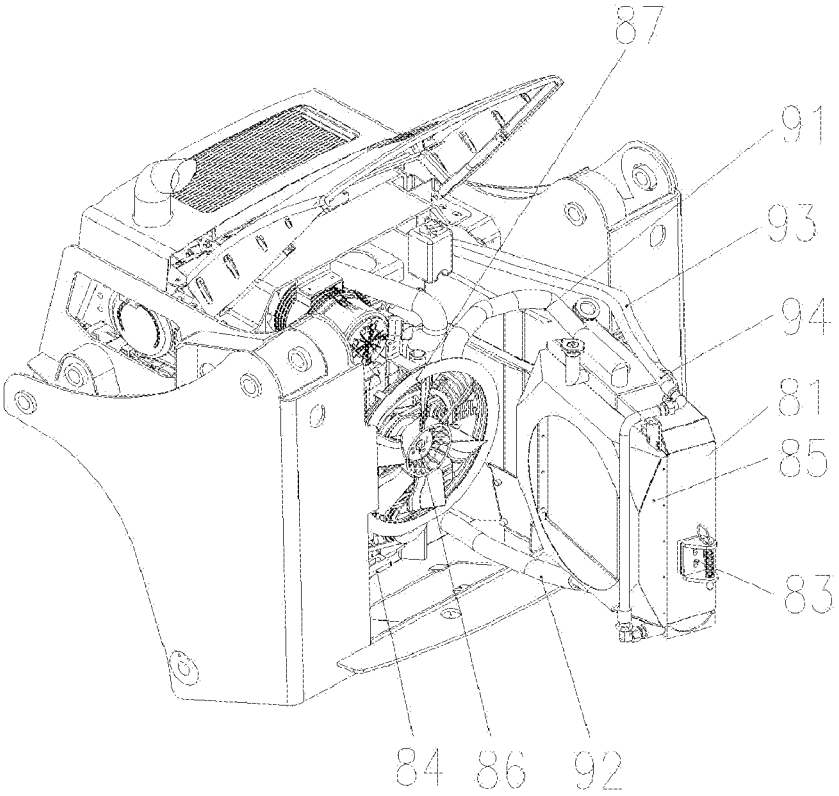
FIG. 15 is a schematic diagram in which the heat dissipation water tank of the skid steer loader is in an open state in Embodiment 1.

Referring to FIG. 14 and FIG. 15, a heat dissipation water tank 81 of the power system is assembled between the left frame 11 and the right frame 12 and is located at a tail portion of the engine, to perform air cooling on a cooling liquid inside the engine and a hydraulic oil of the hydraulic system. In this embodiment, the heat dissipation water tank 81 adopts an openable structure. One side of a tank body of the water tank is hinged to a tail portion of the right frame 12 by a water tank mounting hinge 82, and a water tank lock pin 83 arranged on the other side of the heat dissipation water tank 81 is inserted into a bolt limiting block 84 on the frame of the other side, to lock and assemble the heat dissipation water tank. An air guide cover 85 covering an entire cross section of the heat dissipation water tank is arranged on an inner side of the heat dissipation water tank 81. After the heat dissipation water tank 81 is locked and assembled, the air guide cover 85 is engaged with a protection cover 87 arranged at an air outlet of a heat dissipation fan 86 of the power system. The air guide cover 85 is pressed on and in contact with the protection cover 87 for sealing, and air generated through rotation of the heat dissipation fan 86 can be centrally inputted to the heat dissipation water tank 81, to reduce the loss of air volume. After the water tank lock pin 83 is pulled out from the bolt limiting block 84, the heat dissipation water tank 81 may be opened toward the rear of the chassis frame, to directly expose the internal power system, thereby facilitating inspection and maintenance of the power system.

In this embodiment, the heat dissipation water tank can cool the cooling liquid of the engine and the hydraulic oil of the hydraulic system simultaneously. A cooling water channel and a hydraulic oil channel are provided inside the heat dissipation water tank 81. An engine upper water pipe 91 and an engine lower water pipe 92 of the power system are respectively connected to two ends of the cooling water channel. An oil inlet pipe 93 and an oil return pipe 94 are arranged on two ends of the hydraulic oil channel in an extending manner, and oil in an oil return pipe of the hydraulic system flows back into a hydraulic oil tank through the oil inlet pipe 93 and the oil return pipe 94.

The heat dissipation water tank 81 is located at the tail portion of the chassis frame 1. A tail gate 13 is arranged at an outermost side of the heat dissipation water tank 81. A tail baffle plate 131 is welded on a lower portion of the tail gate 13, and the tail baffle plate slightly extends out of the tail gate 13. A tail reinforcing plate 132 is welded on the tail baffle plate 131, to effectively prevent the loader from striking the tail gate 13 due to reversing when the loader is in a working state, thereby protecting the internal heat dissipation water tank from being damaged.

Implementations of the Present Invention

Embodiment 2

Figure 16:
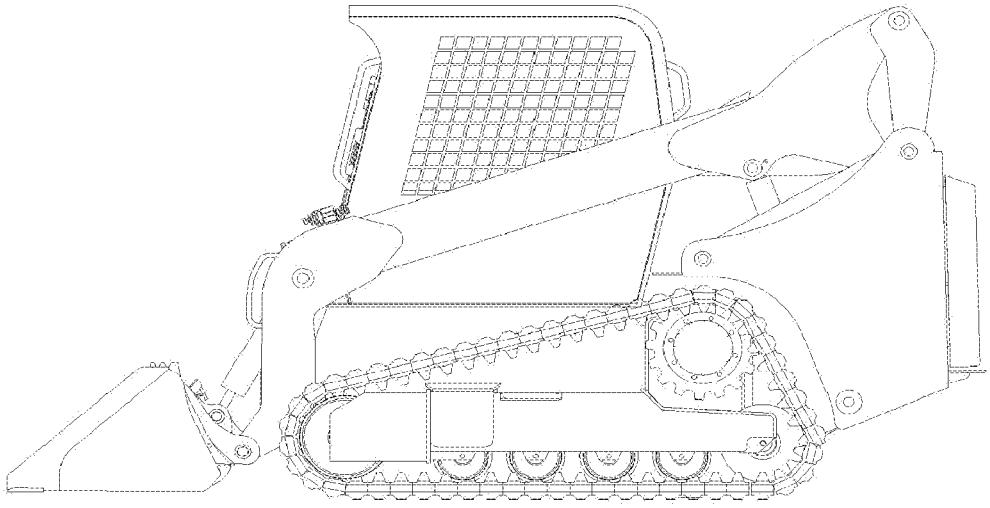
FIG. 16 is a three-dimensional schematic diagram of a skid steer loader in Embodiment 2.

Referring to FIG. 16, the skid steer loader in the figure is another specific implementation of the present invention. The skid steer loader in Embodiment 1 adopts a wheeled walking system. In this embodiment, a crawler type walking system is carried on a chassis frame the same as that in Embodiment 1. According to an arrangement position of the crawler type walking system, the crawler type walking system may be carried by replacing an axle support with a crawler support. The crawler type walking system has a more stable load balance in loading and unloading movement of an entire vehicle, and has a stronger off-road driving capability than the wheeled walking system.

The above descriptions are merely exemplary embodiments of the present invention, but are not to limit the present invention in any form. Although the present invention has disclosed the exemplary embodiments as above, the exemplary embodiments are not used to limit the present invention. A person skilled in the art can make, without departing from the scope of the technical solutions of the present invention, many possible variations and modifications to the technical solutions of the present invention by using the technical content disclosed above, or revise the technical solutions of the present invention to equivalent embodiments with equivalent changes. Therefore, any simple alterations, equivalent changes, and modifications that are made to the foregoing embodiments according to the technical essence of the present invention without departing from the content of the technical solutions of present invention all fall within the protection scope of the technical solutions of the present invention.

What is claimed is:

1. A skid steer loader, comprising:

a chassis frame, assembled with a walking system to form a movable chassis of the skid steer loader, wherein a power system of the skid steer loader is assembled to a tail portion of the chassis frame;

a cab, arranged on a front portion of the chassis frame in an overturning manner, wherein a first side of the bottom of the cab is fixedly hinged to the chassis frame, a second side of the bottom of the cab is supported and connected to the chassis frame at a position other than a hinged position by a telescopic support rod, and the cab is horizontally placed on the chassis frame when the telescopic support rod is in a retracted state and overturns forward towards a front of the skid steer loader when the telescopic support rod is in an extended state, to expand an inspection space between the cab and the power system; and a main beam and a bucket, wherein a tail end of the main beam is movably hinged to the tail portion of the chassis frame by a four-bar linkage mechanism, the bucket is assembled to a front end of the main beam, a loading and unloading oil cylinder for driving loading and unloading is assembled between the bucket and the main beam, and a lifting oil cylinder for driving the main beam to swing up and down to lift and lower the bucket is assembled between the main beam and the chassis frame, wherein a main beam safety rod is arranged on the main beam, one end of the main beam safety rod is hinged to a hinge point of the main beam and the lifting oil cylinder, and a safety rod fixing plate for detachably fixing the main beam safety rod is arranged at a position close to the front end of the main beam; and the main beam safety rod is provided with a through groove for accommodating a piston rod of the lifting oil cylinder, a length of the through groove corresponds to an extending length of the piston rod of the lifting oil cylinder, and when the main beam controls the bucket to be in a lifted state, the main beam safety rod swings toward a back of the skid steer loader to cover the piston rod of the lifting oil cylinder, and an end portion of the main beam safety rod abuts against an end portion of a cylinder barrel of the lifting oil cylinder, to prevent the piston rod of the lifting oil cylinder from retracting into the cylinder barrel.

2. The skid steer loader according to claim 1, wherein two groups of main beams are arranged on two sides of the cab in parallel, the two groups of main beams are integrally connected by horizontal connectors located at front and rear positions of the cab, front ends of the two groups of main beams are connected to the bucket by two groups of synchronized loading and unloading oil cylinders, tail ends of the two groups of main beams are movably hinged to the chassis frame by four-bar linkage mechanisms, and two groups of synchronized lifting oil cylinders are arranged between the chassis frame and the two groups of main beams.

3. The skid steer loader according to claim 2, wherein a top of the bucket and the horizontal connector in front of the cab are respectively provided with pedals, and the pedals form an access passage of the cab.

4. The skid steer loader according to claim 1, wherein the four-bar linkage mechanism comprises a swing frame, a rear connecting rod, and a front connecting rod, the swing frame is fixed to the tail end of the main beam, two hinge points arranged on the swing frame are respectively hinged to the rear connecting rod and the front connecting rod, the rear connecting rod and the front connecting rod are respectively fixedly hinged to two hinge points on the chassis frame, the rear connecting rod is located behind the front connecting rod, a hinge point position of the rear connecting rod on the chassis frame is higher than a hinge point position of the front connecting rod on the chassis frame, and a length of the rear connecting rod is less than a length of the front connecting rod; and a first end of the lifting oil cylinder is fixedly hinged to the chassis frame, and a second end of the lifting oil cylinder is hinged to a third hinge point position on the swing frame.

5. The skid steer loader according to claim 4, wherein the lifting oil cylinder is perpendicular to the main beam when the bucket is lowered to a lowest position, and a ratio of a distance between the two hinge points of the swing frame with the rear connecting rod and the front connecting rod to a distance between hinge points on two ends of the rear connecting rod to a distance between the two hinge points of the chassis frame with the rear connecting rod and the front connecting rod to a distance between hinge points on two ends of the front connecting rod is 12:11:18:16.

6. The skid steer loader according to claim 1, wherein a cab safety rod is arranged on the telescopic support rod, the cab safety rod is a hollow sleeve rod and is freely sleeved on the telescopic support rod, the cab safety rod and a small diameter end of the telescopic support rod are hinged and assembled to a same hinge point, and an axial length of the cab safety rod does not exceed a length of a small diameter rod of the telescopic support rod.

7. The skid steer loader according to claim 1, wherein the tail portion of the chassis frame is divided into a left frame and a right frame, and concave spaces are respectively formed inside the left frame and the right frame for fixedly embedding a hydraulic oil tank module and a fuel tank module of the power system.

8. The skid steer loader according to claim 7, further comprising fuel tank fixing plates, wherein the fuel tank fixing plates are welded to an outer side wall of the right frame, and wherein a first fuel tank fixing plate of the fuel tank fixing plates is disposed substantially horizontally and a second fuel tank fixing plate of the fuel tank fixing plates is disposed substantially vertically.

9. The skid steer loader according to claim 7, wherein the power system on the chassis frame is integrated and assembled between the left frame and the right frame, the left frame and the right frame are connected by a left and right frame connector, an air filter element is fixedly arranged on the left and right frame connector, an air inlet of the air filter element is connected to an air inlet connecting pipe arranged on a frame on a first side by an air inlet guide pipe, and an air outlet of the air filter element is connected to an air inlet unit of the power system by a pipe; and an exhaust port of the power system is connected to an exhaust tail pipe by an exhaust flange pipe, and the exhaust tail pipe is fixed by a tail pipe support on a frame on a second side and extends out of a top middle cover.

10. The skid steer loader according to claim 9, wherein a heat dissipation water tank of the power system is assembled between the left frame and the right frame, a first side of the heat dissipation water tank is hinged to a tail portion of the frame on the first side, a water tank lock pin arranged on a second side of the heat dissipation water tank is inserted into a bolt limiting block on the frame on the second side, to lock and assemble the heat dissipation water tank, engagement of the water tank lock pin with the bolt limiting block is released, and the heat dissipation water tank is opened outward to expose the power system inside the dissipation water tank;

an air guide cover covering an entire cross section of the heat dissipation water tank is arranged on an inner side of the heat dissipation water tank, and the air guide cover is engaged with an air outlet of a heat dissipation fan of the power system when the heat dissipation water tank is in a locked state; and a cooling water channel and a hydraulic oil channel are provided inside the heat dissipation water tank, an engine upper water pipe and an engine lower water pipe of the power system are respectively engaged with two ends of the cooling water channel, and hydraulic oil in a hydraulic return pipe of the power system flows back into a hydraulic oil tank through the hydraulic oil channel.

* * * * *